United States Patent [19]

Deinlein-Kalb

[11] 4,030,296

[45] June 21, 1977

[54] HYDRAULIC DEVICE FOR ROTATING A TURBINE

[75] Inventor: Hans Deinlein-Kalb, Nurnberg, Germany

[73] Assignee: AEG-Kanis Turbinenfabrik GmbH, Germany

[22] Filed: Apr. 8, 1976

[21] Appl. No.: 674,909

[30] Foreign Application Priority Data

Apr. 18, 1975 Germany ..... 2517187
Mar. 11, 1976 Germany ..... 7512424[U]

[52] U.S. Cl. ..... 60/486; 60/721; 290/52

[51] Int. Cl.[2] ..... F15B 13/09

[58] Field of Search ..... 60/327, 486, 700, 715, 60/721; 290/52

[56] References Cited

UNITED STATES PATENTS 3,953,787 4/1976 Helbling ..... 60/327 X

OTHER PUBLICATIONS

B584,520, Jan. 1976, Rice, 60/486 X.

*Primary Examiner*—Edgar W. Geoghegan
*Attorney, Agent, or Firm*—McGlew and Tuttle

[57] ABSTRACT

A device for rotating a turbine, particularly during starting, comprises a positive displacement-type main oil pump which has a main pump suction which is connected to the discharge of a high pressure oil pump which also has a connection to supply oil to the bearings. An auxiliary oil pump is mechanically coupled to the high pressure pump and it is also hydraulically connected in series to the high pressure pump. When the pressure builds up between the high pressure pump and the main pump, the main pump may be driven as a motor by the high pressure pump to effect a turning of the turbine.

3 Claims, 1 Drawing Figure

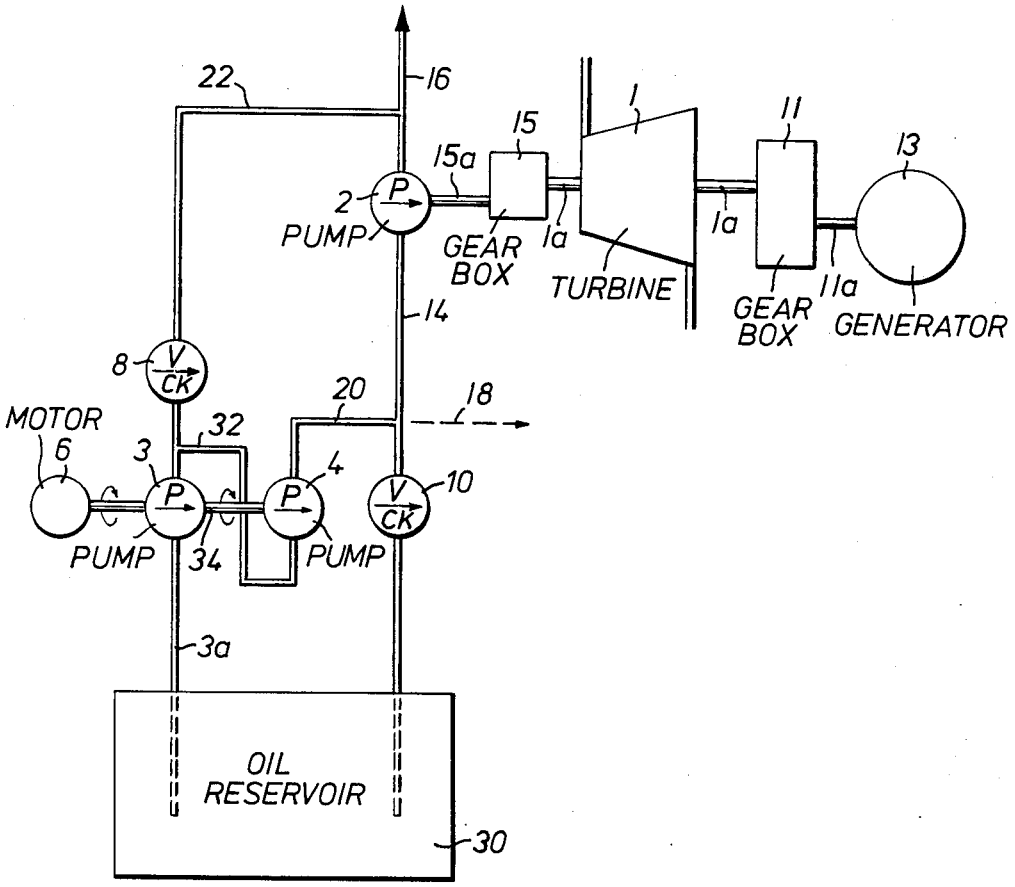
22
16
15
15a
1
11
13
2
PUMP
GEAR BOX
1a
TURBINE
1a
GEAR BOX
11a
GENERATOR
14
8
V
CK
20
18
MOTOR
6
32
3
4
10
PUMP
34
PUMP
3a
OIL RESERVOIR
30

HYDRAULIC DEVICE FOR ROTATING A TURBINE

FIELD AND BACKGROUND OF THE INVENTION

This invention relates in general to the construction of devices for rotating turbines and, in particular, to a new and useful arrangement wherein a positive displacement mail oil pump which is usually driven by the turbine is supplied with pressure from the high pressure pump to drive the turbine to bring it up to operating speed.

DESCRIPTION OF THE PRIOR ART

Arrangements for connecting a main pump to a turbine for driving it under particular circumstances are known, but such devices require particular provisions for enabling them to serve their purpose correctly because, in the first place, the normal pressure of an auxiliary oil pump is not enough for driving a main oil pump at a sufficiently high speed and, in the second place, there must be some provision for switching stop valves in order to be able to drive the main oil pump as a motor. For the first reason, either a motor with a commutable pole for driving the auxiliary oil pump or a variable transmission for coupling the main oil pump to the turbine shaft must be provided, or even both. For the second reason, at least one separate monitoring system or an additional automatically controlled switching mechanism for the valves is necessary, in particular for the starting of the turbine. Another possibility would be a design of a largely over-dimensioned auxiliary oil pump.

SUMMARY OF THE INVENTION

The present invention provides an automatically starting rotary device for rotating a turbine which is reliable in operation and is usable for monitoring and may be constructed and operated with very little cost.

In accordance with the invention, an auxiliary oil pump is connected mechanically to a high-pressure pump and it is also connected to discharge into the high-pressure pump and into a bypass line. The high-pressure pump comprises a known jacking pump which is provided for relieving the pressure exerted by the bearings and it is permanently mechanically coupled and hydraulically connected in series to the auxiliary pump. In addition, the high-pressure pump is connected to deliver into the suction line of the main oil pump. Because a high-pressure pumping supply is necessary for the high bearing oil pressure relief, in any case, the apparatus does not involve additional costs, but nevertheless, it provides a reliable operation of the rotary device in case of need and with a maximum of security.

Accordingly, it is an object of the invention to provide an improved device for rotating a turbine which includes a positive displacement main pump connected to the turbine and normally driven by the turbine and an auxiliary pump connected mechanically and hydraulically in series to a high-pressure pump which discharges to the suction of the main pump and is also provided for supplying the bearings.

A further object of the invention is to provide a device for rotating a turbine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a schematic representation of a system for rotating a turbine, constructed in accordance with the invention.

DESCRIPTION OF THE PREFERRED EMBODIMENT

Referring to the drawing in particular, the invention embodied therein, comprises an apparatus for rotating a turbine 1, which in the embodiment illustrated has a transmission or gear box 11 connected to a generator 13. Turbine 1 includes a shaft 1*a* which is connected into gear box 11, and gear box 11 includes an output shaft 11*a* connected to the generator 13. At its opposite end, shaft 1*a* is connected to a gear box 15, which has an output shaft 15*a* which is connected to a main oil pump 2. The main oil pump comprises a positive displacement pump or gear pump and it discharges through a line 16.

In accordance with the invention, an auxiliary oil pump 3 has a suction line 3*a* connected to an oil reservoir 30 and a discharge which connects into a bypass line 22. A connection line 32 provides means for discharging from auxiliary pump 3 into a suction of a high-pressure pump 4. Thus, the auxiliary oil pump 3 and the high-pressure pump 4 are mounted hydraulically in series and, in addition, they are mechanically coupled together by a shaft 34 which is driven from a single motor 6.

In accordance with a feature of the invention, the high-pressure pump 4 has a discharge 20 which connects into a suction line 14 for the main oil pump 2. In addition, it has a discharge connection 18 for supplying oil to the bearings of the turbine system.

If, prior to, or during the start of the turbine 1, the auxiliary oil pump 3 for delivering lubricating and control oil is switched on, the high-pressure pump 4 which is mechanically coupled thereto through the shaft 34 and which at its suction side is fed with low pressure oil from the auxiliary oil pump which is fed through discharge line 22 and discharge line 32, is therefore also started simultaneously. At its pressure side, the high-pressure pump 4 delivers into the suction line 14 of the main oil pump 2. As long as the main oil pump 2 continues to deliver a greater volume than high pressure pump 4 during the run-down time, no pressure increase will occur in suction line 14. However, as soon as turbine 1 decreases its speed and thereby the speed of the main oil pump 2 to an extent that the small volume which is supplied by high pressure pump 4 can no longer pass through the main oil pump 2 without pressure increase, the increased pressure in suction line 14 will close a check valve 10 and, upon further increase of pressure, the main oil pump 2 is driven as a torque motor. At the same time, high-pressure oil will be supplied by high-pressure pump 4 through the line 18 to the bearings of the system.

In respect to power output, of course, the hydraulic rotary device or rotary system may be designed so as to permit the rotary motion of the turbine from a standstill. When the turbine is run up to speed through the operation of the device, the main oil pump 2 then takes over the delivery of oil automatically.

The inventive mechanical and hydraulic coupling of the auxiliary oil pump 3 to the high-pressure pump 4 and the connection of the discharge of the high-pressure pump to the suction of the main oil pump 2 provides a maximum reliability in service because the conditions which are substantial for the operation of the rotary device, that is, the switching on and off of the auxiliary oil pump and the supply of lubricating oil to the turbine bearings, are picked up and maintained automatically.

While a specific embodiment of the invention has been shown and described in detail to illustrate the application of the principles of the invention, it will be understood that the invention may be embodied otherwise without departing from such principles.

What is claimed is:

1. A device for rotating a turbine, particularly during starting, comprising a positive displacement-type main oil pump having a main oil pump suction, and having a shaft connected to the turbine and normally driven by the turbine, an auxiliary oil pump, a high-pressure oil pump having a discharge which is adapted to be connected for supplying bearing oil pressure and which is connected to said suction of said main oil pump, said auxiliary oil pump being mechanically coupled to said high-pressure oil pump and being hydraulically connected in series to said high-pressure oil pump, said high-pressure pump being connected to discharge to said main oil pressure pump suction to drive said main oil pressure pump as a motor when the speed of the turbine is low enough so that the main oil pressure pump does not deliver a quantity of oil sufficient to prevent a buildup of pressure in the suction of said main oil pressure pump.

2. A device for rotating a turbine, according to claim 1, wherein said discharge of said high-pressure pump includes a connection for supplying pressure oil to bearings, an oil return line connected to said high-pressure pump discharge and said main oil pump suction having a check valve therein which closes against reverse flow in said discharge line to said drain line when the pressure in said high-pressure pump discharge line exceeds a predetermined amount.

3. A device for rotating a turbine, according to claim 1, wherein said auxiliary pump discharge includes a bypass connection to the discharge of said main oil pump and a check valve in said bypass connection preventing return flow from said main oil pressure pump discharge through said bypass to said auxiliary pump discharge.

* * * * *